United States Patent [19]

Bushfield

[11] Patent Number: 4,790,780

[45] Date of Patent: Dec. 13, 1988

[54] ELECTRICAL CONNECTING APPARATUS

[75] Inventor: Harold D. Bushfield, Bloomington, Ill.

[73] Assignee: Olin Fabricated Metal Products, Inc., Bloomington, Ill.

[21] Appl. No.: 85,563

[22] Filed: Aug. 17, 1987

[51] Int. Cl.[4] ..... H01R 9/24

[52] U.S. Cl. ..... 439/887

[58] Field of Search ..... 439/887, 801

[56] References Cited

U.S. PATENT DOCUMENTS 4,181,396 1/1980 Olashaw ..... 439/887

*Primary Examiner*—Gil Weidenfeld
*Assistant Examiner*—Paula A. Austin
*Attorney, Agent, or Firm*—R. Gale Rhodes, Jr.

[57] ABSTRACT

Electrical connecting apparatus for electrically interconnecting an electrical energy source and electrical energy utilization apparatus including a first electrical conductor of a first electrically conductive material such as copper, a second composite electrical conductor including a third electrical conductor of a second electrically conductive material such as aluminum and a fourth electrical conductor of the first electrically conductive material, the third and fourth electrical conductors electrically and mechanically interconnected such as by roll bonding, one end of the first electrical conductor electrically and mechanically interconnected with the fourth electrical conductor such as by electron beam welding, a fifth electrical connector comprised of a plurality of layers of second electrically conductive material one end of which is electrically and mechanically interconnected to the third electrical conductor such as by metal arc welding, the other end of the first electrical conductor for being electrically and mechanically interconnected to the electrical energy utilization apparatus such as by being bolted thereto and the other end of the fifth electrical connector for being electrically and mechanically interconnected with the electrical energy source such as by metal arc welding.

4 Claims, 1 Drawing Sheet

FIG. 1
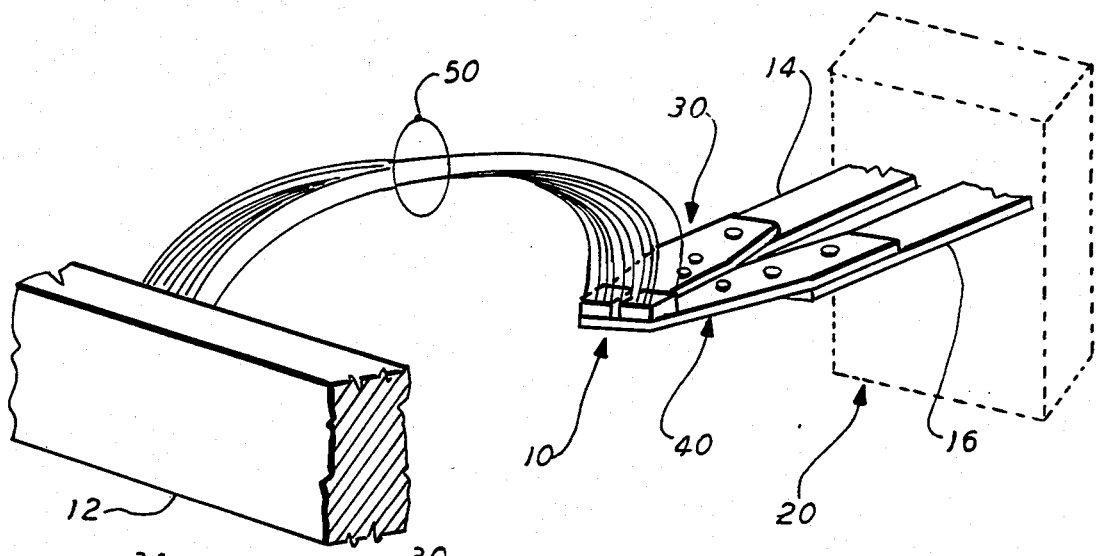
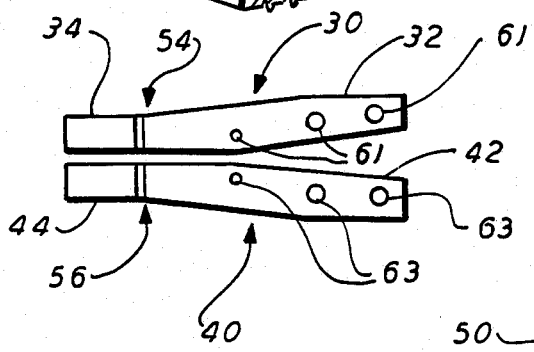
FIG. 2
FIG. 3
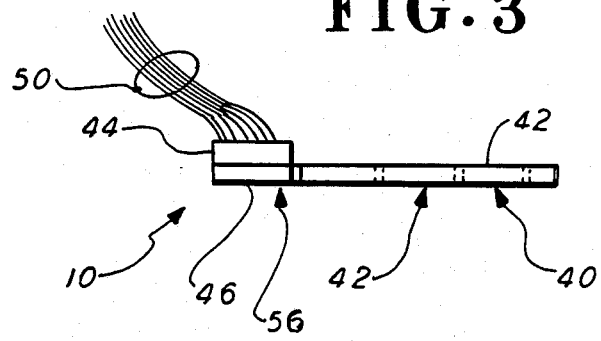
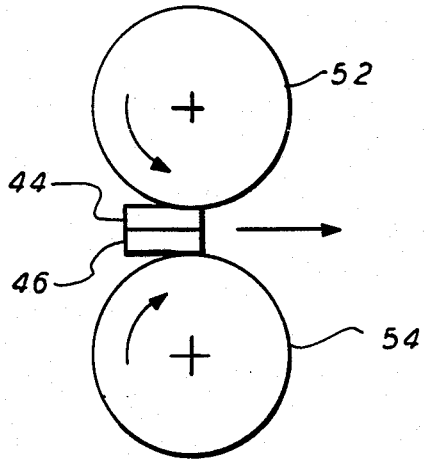
FIG. 4

ELECTRICAL CONNECTING APPARATUS

BACKGROUND OF THE INVENTION

This invention relates generally to new and improved electrical connecting apparatus and more particularly relates to a new and improved bi-metal electrical connector particularly useful, by way of example, for electrically interconnecting an electrical energy source, such as a bus-bar, and an electrical energy utilization device such as an aluminum cell for producing aluminum from alumina.

As known to those skilled in the art, the prior art is replete with a multitude of different electrical connectors of a multitude of different sizes, shapes, and electrically conductive materials. Included in such prior art electrical connectors, as is further known, is a class of electrical connectors referred to as bi-metal metal electrical connectors comprised of two different electrically conductive materials such as copper and aluminum. As is still further known, such bi-metal electrical connectors are used to establish or provide an electrical connection between two dissimilar electrically conducting members which may or may not be of the same electrically conducting materials as those comprising the bi-metal electrical connector. As is still further known, such bi-metal electrical connectors are more efficient, suffer less electrical losses such as voltage drops, than an electrical connector of a single electrically conductive material when utilized to establish an electrical connection between electrical members of different electrically conductive materials.

An example of a known need for bi-metal electrical connectors is that of establishing electrical interconnection between an aluminum bus-bar and a steel electrical connector or terminal provided on an aluminum cell wherein alumina is reduced to form aluminum. It has been found that establishing an electrical connection between the aluminum bus-bar and the steel terminal by the use of an electrical conductor of a single electrically conductive material is unwantedly inefficient and suffers unwanted energy losses such as unwanted voltage drops. As is also known to those skilled in the art, a prior art bi-metal electrical conductor is known for establishing an electrical interconnection between such aluminum bus-bar and the steel terminal of an aluminum cell. Such prior art bi-metal electrical connector includes a copper casting which is cast in a mold either before or after an aluminum casting is cast in the same mold resulting in a copper conductor having an aluminum conductor cast about one end; the copper conductor is thereafter connected by bolting to the steel terminal of the aluminum cell, and the aluminum conductor is connected to the aluminum bus-bar such as by flexible aluminum sheets welded therebetween.

However, it has been found that such prior art bi-metal electrical connectors particularly useful for connecting the aluminum bus-bar and steel terminal of aluminum cell are unwantedly expensive and hence there exists a need in this art for a new and improved bi-metal electrical connector which is less expensive than the noted prior art cast bi-metal electrical connector and which is particularly useful for electrically interconnecting an aluminum bus-bar and steel terminal of an aluminum cell.

SUMMARY OF THE INVENTION

Electrical connecting apparatus for electrically interconnecting an electrical energy source and electrical energy utilization apparatus including a first electrical conductor of a first electrically conductive material such as copper, a second composite electrical conductor including a third electrical conductor of a second electrically conductive material such as aluminum and a fourth electrical conductor of the first electrically conductive material, the third and fourth electrical conductors electrically and mechanically interconnected such as by roll bonding, one end of the first electrical conductor electrically and mechanically interconnected with the fourth electrical conductor such as by electron beam welding, a fifth electrical connector comprised of a plurality of layers of second electrically conductive material one end of which is electrically and mechanically interconnected to the third electrical conductor such as by metal arc welding, the other end of the first electrical conductor for being electrically and mechanically interconnected to the electrical energy utilization apparatus such as by being bolted thereto and the other end of the fifth electrical connector for being electrically and mechanically interconnected with the electrical energy source such as by metal arc welding. dr

DESCRIPTION OF THE FIGURES

FIG. 1 is a diagrammatical illustration, in perspective, of an electrical connector embodying the present invention and shown establishing an electrical connection between an aluminum busbar and the steel terminal, or terminals, of an aluminum cell;

FIG. 2 is a top or plan view of a pair of feet or legs comprising a portion of the electrical connector of the present invention;

FIG. 3 is a side view of an electrical connector embodying the present invention; and FIG. 4 is a diagrammatical, side elevational view, of a roll bonding process for roll bonding two dissimilar electrically conductive materials comprising a portion of the electrical connector embodying the present invention.

DESCRIPTION OF THE PREFERRED EMBODIMENT

Referring now to FIG. 1, there is shown an electrical connector embodying the present invention and indicated by general numerical designation 10, such electrical connector being particularly useful for establishing electrical interconnection between an aluminum bus-bar 12 and the steel terminals 14 and 16 of an aluminum cell of the type noted above and indicated by general numerical designation 20; such electrical connector when so utilized is sometimes referred to in the art as a cathode strap.

Electrical connector 10 may include a pair of what is referred to in the art as feet or legs indicated respectively by general numerical designations 30 and 40. As may be better understood from FIGS. 2 and 3, legs 30 and 40 are substantially identical, and include, respectively, generally longitudinally extending copper conductors 32 and 42, generally rectangularly shaped aluminum conductors 34 and 44, and generally rectangularly shaped copper conductors 36 (not shown but underlying aluminum conductor 34 in FIG. 2) and 46; as may best be understood from FIG. 3, the aluminum conductors 34 and 44 are of substantially the same size and shape and overlie the copper conductors 36 and 46. Electrical connector 10, as may be understood from FIGS. 1 and 3, further includes a plurality of aluminum layers or sheets indicated generally by numerical designation 50 connected to the aluminum conductors 34 and 44 jointly or commonly as may best be understood by reference to FIG. 1.

In accordance with the further teachings of the present invention, and referring to FIG. 4 and to aluminum conductor 44 and copper conductor 46 by way of example, it will be understood that the aluminum conductors 34 and 44 may be suitably electrically and mechanically interconnected with the underlying copper conductors 36 and 46 by roll bonding wherein it will be understood that by such roll bonding process the bottom portion of the top aluminum conductor 44 is opposed and roll bonded to the underlying top portion of the copper conductor 46 (it will be understood that the aluminum and copper conductors 44 and 46 shown in FIG. 4 are merely illustrative of the roll bonding process and that in practice long strips of the aluminum and copper are roll bonded whereafter the bonded strips are cut to size to form the conductors). Further, as best may be understood from FIGS. 2 and 3, and particularly with regard to FIG. 3, copper conductors 36 and 46 have a side opposed to one end of the copper conductors 32 and 42 and such sides and ends may be suitably joined by electron beam welding with such welds being indicated diagrammatically by the areas identified by general numerical designations 54 and 56. Further, it will be understood in accordance with still further teachings of the present invention, and as best may be understood from FIGS. 1 and 3, particularly FIG. 1, one end of the plurality of aluminum layers or sheets 50 may be electrically and mechanically interconnected jointly or commonly with the top portions of the aluminum conductors 34 and 44 by metal arc welding.

As may be noted from FIGS. 1–3, copper conductors 32 and 42 may be provided, respectively, with a plurality of holes 61–61 and 63–63 extending therethrough which may be utilized to electrically and mechanically interconnect the electrical conductors 32 and 42 to the steel terminals 14 and 16 of the aluminum cell 20 by bolts extending through such holes and corresponding holes formed in the ends of the steel terminals 14 and 16, as illustrated in FIG. 1. The other ends of the plurality of aluminum sheets 50 may be electrically and mechanically interconnected with the aluminum bus-bar 12 by metal arc welding.

It will be understood that the terms copper and aluminum include the alloys thereof.

It will be understood that many variations and modifications may be made in the present invention without departing from the spirit and the scope thereof.

What is claimed is:

1. Electrical connecting apparatus for electrically interconnecting an electrical energy source and electrical energy utilization apparatus, comprising:

a pair of first electrical conductors of a first electrically conductive material;

a pair of second electrical conductors of a second electrically conductive material;

a pair of third electrical conductors of said first electrically conductive material, said second and third electrical conductors of each pair electrically and mechanically interconnected;

said pairs of said first, second and third electrical conductors oriented correspondingly and disposed substantially parallel;

one end of each of said first electrical conductors electrically and mechanically interconnected with one of said third electrical conductors;

a fourth electrical conductor comprised of a plurality of layers of said second electrically conductive material, one end of which is electrically and mechanically interconnected jointly to said pair of second electrical conductors; and the other end of each said first electrical conductors for being electrically and mechanically interconnected with said electrical energy utilization apparatus and the other end of said fourth electrical conductor for being electrically and mechanically interconnected with said electrical energy source.

2. Electrical connecting apparatus according to claim 1 wherein said first electrically conductive material is copper and wherein said second electrically conductive material is aluminum, wherein said second and third electrical conductors of each pair of electrically and mechanically interconnected by roll bonding, wherein said one end os each of said first electrical conductors is electrically and mechanically interconnected with one of said third electrical conductors by electron beam welding, and wherein said one end of said fourth electrical conductor is mechanically and electrically interconnected jointly to said pair of second electrical conductors by metal arc welding.

3. Electrical connecting apparatus according to claim 1 wherein said electrical energy source is an aluminum bus-bar and wherein said other end of said fourth electrical conductor is for being electrically and mechanically interconnected with said bus-bar by metal arc welding; and wherein said electrical energy utilization apparatus is an aluminum cell including a pair of steel terminals and wherein the other ends of said first electrical conductors are for being electrically and mechanically interconnected with said steel terminals by being bolted thereto.

4. Electrical connecting apparatus according to claim 1 wherein said second and third electrical conductors are of substantially the same size and generally rectangularly shaped, wherein said second electrical conductors overlie said third electrical conductors and each includes a bottom portion and wherein each of said third electrical conductors includes a top portion opposed and electrically and mechanically interconnected to said bottom portion of one of said second electrical conductors, wherein each of said third electrical conductors has a side portion opposed and electrically and mechanically interconnected to said one end of one of said first electrical conductors; and wherein said plurality of layers of said second electrically conductive material comprising said fourth electrical conductor is a plurality of aluminum sheets.

* * * * *